United States Patent [19]

Asahi

[11] 4,359,287

[45] Nov. 16, 1982

[54] IMPRESSION CONTROL MECHANISM FOR A TYPEWRITER

[75] Inventor: Tetsuma Asahi, Kodaira, Japan

[73] Assignee: Silver Seiko, Ltd., Tokyo, Japan

[21] Appl. No.: 139,477

[22] Filed: Apr. 11, 1980

[30] Foreign Application Priority Data

Apr. 17, 1979 [JP] Japan ..... 54-051218[U]

[51] Int. Cl.[3] ..... B41J 1/32

[52] U.S. Cl. ..... 400/166; 400/157.3; 101/93.03

[58] Field of Search ..... 400/166, 157.3; 101/93.03

[56] References Cited

U.S. PATENT DOCUMENTS

| | | | |
|---|---|---|---|
| 1,918,300 | 7/1933 | Trego | 400/166 |
| 3,651,710 | 3/1972 | Burkett et al. | 400/166 |
| 3,788,443 | 1/1974 | Menzi | 400/166 |
| 3,888,339 | 6/1975 | Nowak et al. | 400/166 |
| 3,980,169 | 9/1976 | Decker et al. | 400/166 |
| 4,119,384 | 10/1978 | Keiter | 400/166 |

FOREIGN PATENT DOCUMENTS

| | | | |
|---|---|---|---|
| 2156576 | 5/1973 | Fed. Rep. of Germany | 400/166 |
| 2726462 | 12/1978 | Fed. Rep. of Germany | 400/166 |

OTHER PUBLICATIONS

Schaefer "Electronic Control . . . ", IBM Tech. Discl. Bulletin vol. 21, No. 10, pp. 4110–4112, 3/79.

*Primary Examiner*—William Pieprz

*Attorney, Agent, or Firm*—Armstrong, Nikaido, Marmelstein & Kubovcik

[57] ABSTRACT

Print impression control mechanism for regulating the impact velocity of a single element printing head against a platen. The printing head is normally retained to a rest position which is in a fixedly spaced relationship to the platen independent of manual adjustment of an impression control lever so as to provide best visibility of printed characters on the record medium. In a first part of each print cycle, the head is brought to an intermediate position from which it is accelerated to get sufficient velocity for printing in a subsequent second part of the print cycle. Such an intermediate position is determined depending upon manual adjustment of the control lever whereby the impression of the printed characters can be determined accordingly.

6 Claims, 5 Drawing Figures

IMPRESSION CONTROL MECHANISM FOR A TYPEWRITER

BACKGROUND OF THE INVENTION

This invention relates to typewriters and more particularly to print impression control mechanisms for typewriters, especially suitable for single element typewriters.

A single element typewriter having a single element printing head is conventionally provided with an impression control mechanism for regulating the impact velocity of the printing head against a platen to obtain a desired impression of characters printed on a record medium. In such a single element typewriter, a cyclically operable print drive cam is rendered operative in response to depression of any character key and drives a rocker platform to rock around an axis to fly the printing head on the rocker toward the platen. A cam follower transmits driving force of the print cam to the rocker thorugh a motion transmitting pin which is mounted on the rocker and is normally engaged with an arcuate cam section of the cam follower. An impression control lever is manually adjusted to position the motion transmitting pin relative to the arcuate cam section of the cam follower to thereby determine a distance over which the printing head is accelerated by the print cam, which will determine the impact velocity of the printing head against the platen in a well known manner. Such an impression control lever may be mounted on the rocker with the motion transmitting pin being fixed to an end of the lever, or else on a carrier with the cam follower being pivotally mounted on the lever as disclosed in U.S. Pat. No. 3,888,339.

Conventional single element typewriters usually accompany a problem that the printing element is normally located at a position relatively close to the platen so that printed characters on the record medium cannot be observed well by the operator of the typewriter. In a typewriter of the type provided with the above described impression control mechanism, the printing head is moved back and forth relative to the platen in response to manual adjustment of the impression control lever since the motion transmitting pin is normally engaged with the cam section of the cam follower. If the control lever is adjusted so that the possible lowest impression may be attained, the printing head in its rest position comes closest to the platen to provide a minimum spacing left therebetween so that an utmost influence is had on the eyesight of the machine operator. Adjustment of the control lever to a higher impression position would correspondingly widen the spacing between the printing element and the platen to thus improve the operator's eyesight.

SUMMARY OF THE INVENTION

It is, therefore, an object of the present invention to provide an impression control mechanism for a typewriter wherein manually adjusting operations for impression control have no effect on rest position of the printing head relative to the platen, normally maintaining the printing head farthest from the platen to provide best visibility of printed characters on the record medium.

In accordance with the present invention, the printing head is normally held to a predetermined rest position, and in a first part of each print cycle, it is displaced to an intermediate position without providing the printing head with substantial energy for printing. In a subsequent second part of the print cycle, the printing head is accelerated to get sufficient energy or velocity for printing until a predetermined position is reached, and in a last part of the print cycle, it flies to the platen freely by its own inertia and then returns to its rest position. The mentioned intermediate position of the printing head and hence the distance from the intermediate to the predetermined position are determined depending upon manual adjustment of an impression control member or lever. Thus, the printing head is normally retained to its rest position in a constantly spaced relationship to the platen. In a preferred embodiment of the present invention, the motion transmitting pin is normally spaced from the cooperative cam section of the print cam follower and is brought into engagement therewith at a selected point of time during the first part of each print cycle. The print drive cam has a cam profile including a first part for displacing the printing head from the rest to an intermediate position, a second part for accelerating the printing head until the predetermined position is reached, and a third part for allowing the printing head to return to the rest position.

DETAILED DESCRIPTION OF THE INVENTION

Figure 1:
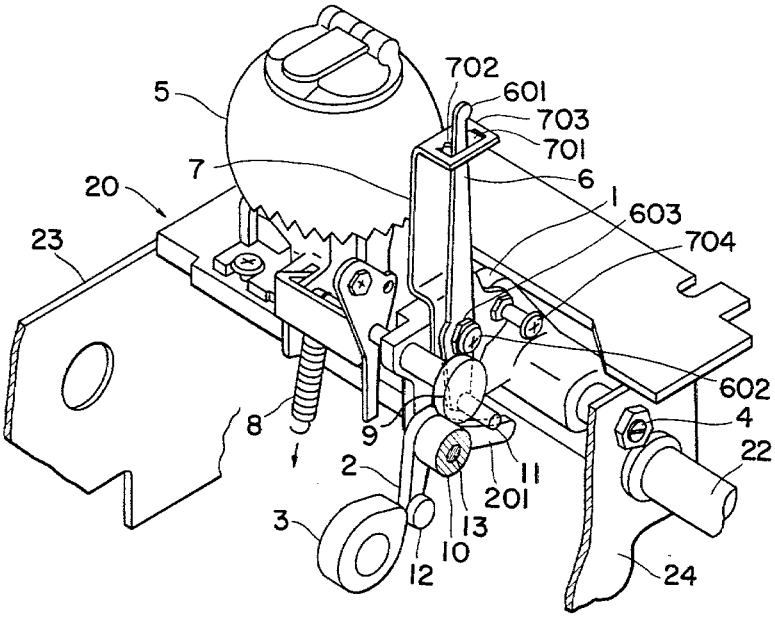
FIG. 1 is a right front perspective view of an impression control mechanism embodying the present invention.

Referring now to FIG. 1, there is illustrated a single element typewriter which includes a single printing element 5 having a plurality of character types embossed and arranged in rows and columns thereon. The printing element 5 is mounted on a rocker member 1 for rotating and tilting motion relative to the rocker 1 to present one of its characters to a printing position for imprinting the selected character on a document (not shown) which may be supported on a cylindrical platen 14. The rocker 1 is carried by a carrier, generally designated at 20, which is mounted for translatory movement along a printing line on a print shaft 21 and a guide rod 22 which extend horizontally across the machine.

Figure 2:
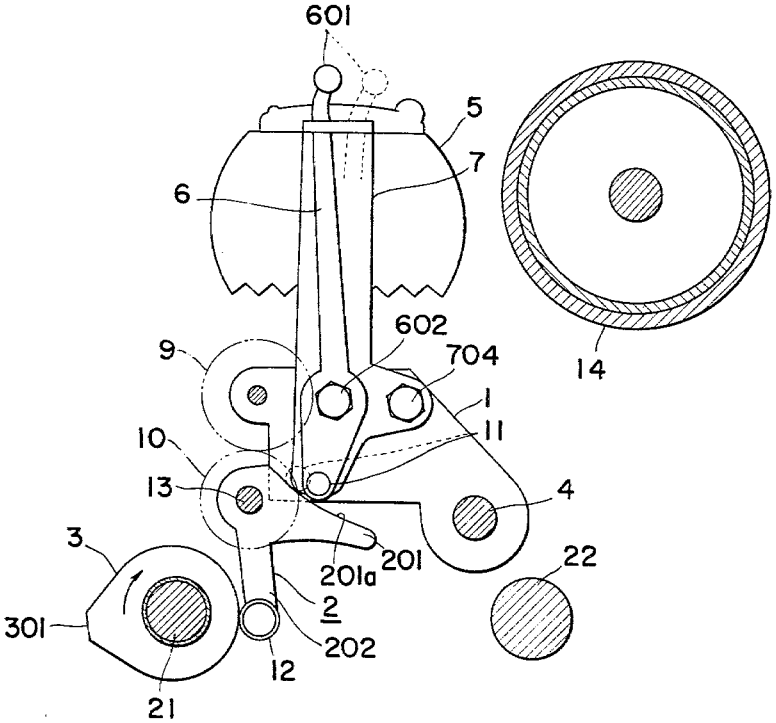
FIG. 2 is a simplified right-hand side view of the impression control mechanism of FIG. 1, showing the mechanism in its home position.

The rocker 1 is mounted for rocking motion about a rocker shaft 4 which has its opposite ends supported on left and right wall sections 23, 24 of a frame of the carrier 20. A spring 8 is tensioned between the rocker 1 and the carrier frame and urges the rocker 1 and hence the printing element 5 in a counterclockwise direction about the shaft 4 from a printing position on the platen 14 to a rest position as illustrated in FIG. 2. An abutment member or pin 9 secured to the rocker 1 normally abuts against a roller 10 to retain the rocker 1 and the printing element 5 to their rest position against the urging of the spring 8.

Figure 4:
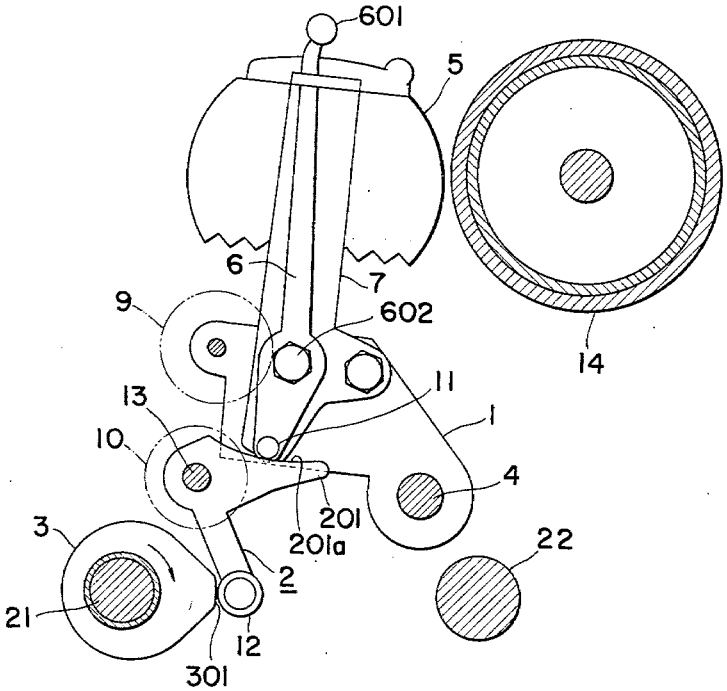
FIG. 4 is a similar side view, showing the impression control mechanism at the end of a second part of a print cycle.

The roller 10 is rotatably supported on a pin 13 which is secured to the right side wall section 24 of the carrier frame. A cam follower member or bellcrank 2 is pivotally mounted on the pin 13 and has an arm 201 which has an arcuate cam profile 201*a* formed on an upper edge thereof. The bellcrank 2 has another arm 202 which has a roller 12 rotatably mounted on a free end thereof. A print drive cam 3 is located adjacent to the roller 12 of the cam follower bellcrank 2 and is mounted on the print shaft 21 such that it is translated relative to the print shaft 21 together with the carrier 20 and is rotated by the print shaft 21 when the shaft 21 is driven to rotate about its axis. The print shaft 21 is connected to a constantly rotating drive motor (not shown) by means of a belt and pulley drive (not shown) as in a conventional manner. A suitable cycle clutch (not shown) is provided which is released upon depression of any character key (not shown) provided for the machine for connecting the print shaft 21 to the constantly rotating drive motor to allow the print shaft 21 to rotate one complete rotation. Thus, upon a rotation of the print shaft 21, the print cam 3 is rotated clockwise so that its cam lobe 301 which is engaged with the roller 12 of the cam follower bellcrank 2 forces the bellcrank 2 to pivot counterclockwise about the pin 13 from a normal rest position as shown in FIG. 2 to a pivoted position as shown in FIG. 4.

Counterclockwise pivotal motion of the bellcrank 2 is transmitted to the rocker 1 by means of a motion transmitting element or pin 11 which is normally located adjacent to the cam profile 201*a* of the bellcrank 2. The pin 11 is fixedly mounted at a lower end of a manually operable impression control lever 6 which is mounted on the rocker 1 by a fastening screw 602 for pivotal motion about the screw 602. A detenting bracket 7 is interposed between the lever 6 and the rocker 1 and is mounted on the rocker 1 by the screw 602. Preferably, a spacer collar 603 having an eccentric cam section (not shown) may be interposed between the head of the screw 602 and the bracket 7 such that turning of the collar 603 about the screw 602 displaces the control lever 6 relative to the bracket 7 for the purpose of fine adjustment of the lever 6 as in a well known manner. Also, the bracket 7 may preferably be angularly adjustable about the fastening screw 602 by means of an elongaged hole (not shown) suitably formed in the bracket 7 through which hole another fastening screw 704 extends to secure the bracket 7 in an adjusted position to the rocker 1. The bracket 7 extends upwardly and has at the top thereof a bent horizontal section 703 which has a window opening 701 formed therein. A plurality of, five in the preferred embodiment, of notches 702 are formed along an edge of the bracket bent section 703 defining the opening 701. An upwardly extending arm 601 of the impression control lever 6 extends through the opening 701 in the bracket bent section 703 and is urged by its own resiliency to snap in one of the detent notches 702 of the bracket 7 to be detented thereby in one of the five detented positions thus defined by the detent notches 702. Thus, the impression control lever 6 can be manually adjusted to one of the first to fifth detented positions in accordance with impression requirements: if the lowest impression is intended, the lever 6 may be adjusted to the first position which is farthest from the machine operator (phantom position in FIG. 2), and if the highest impression is required, the lever 6 may have to be adjusted to the fifth position nearest to the operator.

Figure 5:
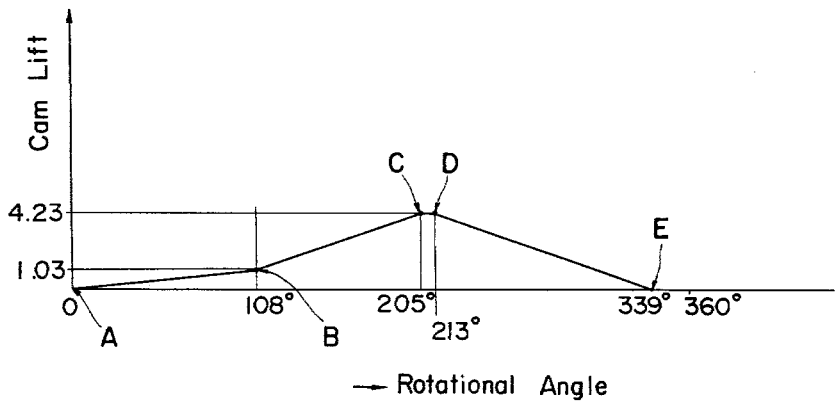
FIG. 5 is a cam diagram, illustrating the cam profile of a print drive cam according to the present invention.

According to the present invention, the motion transmitting pin 11 is normally spaced from the cooperative cam profile 201*a* of the bellcrank 2 as illustratively shown in full line in FIG. 2 unless the impression control lever 6 is adjusted to the first detented position in which the pin 11 is just or almost in contact with the cam profile 201*a* of the cam follower bellcrank 2. Accordingly, the printing element 5 is normally held to its rest position in a fixedly spaced relationship relative to the platen 14 irrespective of the position of the impression control lever 6. In order to provide a control speed for printing to the printing element 5 from a single print drive cam 3, the print cam 3 according to the present invention has a cam profile consisting substantially of three different parts; i.e., a first part for displacing the printing element 5 from the rest to an intermediate position without providing the printing element 5 with substantial energy for printing, a second part for accelerating the printing element 5 to provide the element 5 with sufficient energy or velocity for printing, and a third part for allowing the printing element 5 to return to its rest position. The cam profile of the print cam 3 can be seen from FIG. 5 which represents cam lift relative to rotational angle of the print cam 3. In FIG. 5, the first cam profile part is represented by a line beginning at point A and ending at point B, the second part by a line B-C, and the third part by a poligonal line C-D-E. As seen in FIG. 5, line A-B is significantly moderate in inclination compared with line B-C depending upon the duties assigned thereto. It is to be noted that, although the diagram of FIG. 5 represents the cam profile of the print cam 3 generally in the form of a poligonal line, the print cam 3 may preferably have a gradually changing curved line as of a conventional print drive cam, and especially at the second cam profile part, it may have a similar profile to that of a conventional print drive cam.

Figure 3:
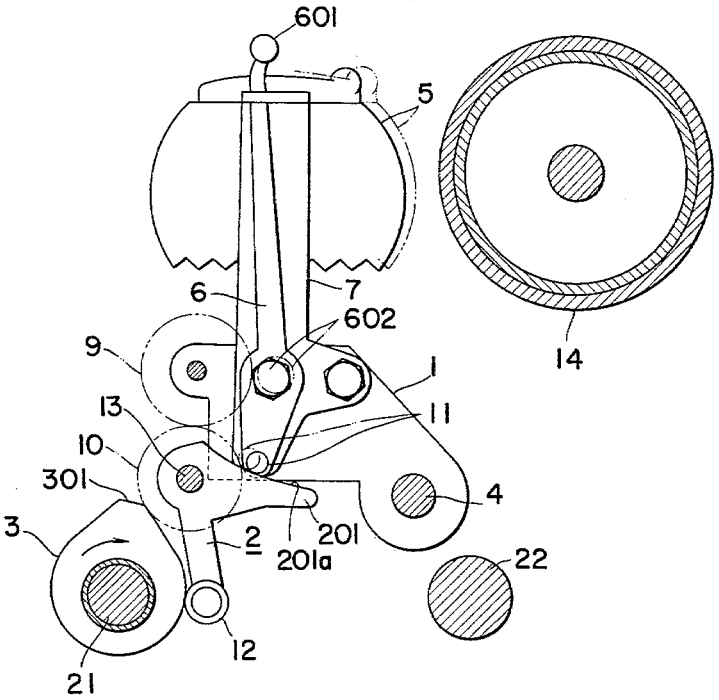
FIG. 3 is a similar side view, showing the impression control mechanism at the end of a first part of a print cycle.

In its initial position the impression control lever 6 is adjusted to the fifth detented position as shown in full line in FIG. 2 in which position the motion transmitting pin 11 thereon is spaced from the arcuate cam profile 201*a* of the cam follower bellcrank 2 when the print cam 3 is in its home position and the printing head 5 is in its rest position with the abutment member 9 abutting against the roller 10 on the fixed pin 13. The print cam 3 is then first rotated an angle of 108 degrees from the position as shown in FIG. 2 to the position as shown in FIG. 3 to pivot the bellcrank 2 counterclockwise about the pin 13 before the cam profile 201*a* of the bellcrank 2 is brought into engagement with the motion transmitting pin 11. Thus, the first cam profile part of the print cam 3 which defines a first part of a print cycle does not act on the motion transmitting pin 11. In a second part of a print cycle in which the cam 3 is rotated from the rotational FIG. 3 position of 108 degrees to the rotational FIG. 4 position of 205 degrees, the print cam 3 pivots the bellcrank 2 from the FIG. 3 to FIG. 4 position thereby rocking, through driving engagement of the cam profile 201*a* of the bellcrank 2 with the motion transmitting pin 11, the rocker 1 and hence the printing element 5 from their rest position (FIG. 2) to a position as shown in FIG. 4. In the remaining third part of a print cycle until the print cam 3 completes its one rotation, the printing element 5 first flies freely by its own inertia to impact its selected character type against a document supported on the platen 14 whereafter it is returned to its rest position together with the rocker 1 by means of the restoring spring 8 (FIG. 1). Thus, with the impression control lever 6 adjusted to the fifth detented position, the printing head 5 is accelerated over a distance from the rest to the predetermined FIG. 4 position in the second part of a print cycle.

If the impression control lever 6 is adjusted to a different position, the printing element 5 is operated in a different manner. When the lever 6 is adjusted to the first detented position, the motion transmitting pin 11 is normally engaged with the cam profile 201*a* of the bellcrank 2. Accordingly, even in the first part of a print cycle, the pin 11 is acted upon by the bellcrank 2 to thus displace the printing head 5 from the rest position to an intermediate position as shown in phantom in FIG. 3 so that, in the second part of a print cycle, the printing element 5 is accelerated over a relatively short distance from the intermediate to the predetermined FIG. 4 position, allowing the printing element 5 to be accelerated to a relatively low speed with a low energy, which results in relatively low impression of the printed characters. When the impression control lever 6 is adjusted to the second, third or fourth detented position, the motion transmitting pin 11 is brought into engagement with the cam profile 201*a* of the bellcrank 2 at a respective particular point of time in the first part of a print cycle so that, at the end of the first print cycle part, the printing element 5 is in a respective intermediate position which is intermediate between the full line and phantom positions of FIG. 3, thus determining a distance over which the printing element 5 is accelerated in the second part of a print cycle by the second cam profile part of the print cam 3, which will lead to an intermediate impression of the print characters. It is to be noted here that each of the above described intermediate positions in the present impression control mechanism would correspond to a rest position to which the printing head of a typewriter having a conventional impression control mechanism is normally retained depending upon adjusted position of its impression control member.

What is claimed is:

1. An impression control mechanism for a single element typewriter, comprising:

a platen;

a single printing element;

means mounting said printing element for movement from a fixed rest position towards said platen;

means for defining said fixed rest position of said element;

means for urging said element towards said rest position;

cyclically operable print drive means operable in a particular part of each print cycle for driving said printing element to move towards said platen until a predetermined position is reached whereafter said printing element moves by its own inertia;

manually adjustable impression control means for selectively defining an intermediate position of said printing element between said rest position and said predetermined position to thereby define a distance over which said printing element is driven by said print drive means within said particular part of each print cycle; and means operable in another part of each print cycle immediately preceding said particular part for bringing said printing element from said rest position to the selectively defined intermediate position;

wherein said printing element is normally positioned at said fixed rest position independent of said manually adjustable impression control means to thereby provide an operator of the typewriter with optimum visibility of the printed characters.

2. An impression control mechanism for a single element typewriter, comprising:

a platen;

a single printing element;

means mounting said printing element for movement from a fixed rest position towards said platen;

means for defining said fixed rest position of said element;

means for urging said element towards said rest position;

a cyclically operable print drive cam having a cam profile including a first part for displacing said printing element from said rest to an intermediate position without providing said printing element with substantial energy for printing, and a second part for accelerating said printing element to provide said printing element with energy for printing;

a cam follower mounted for engagement with said print drive cam; and manually adjustable motion transmitting means interposed between said cam follower and said means for mounting for transmitting motion of said cam follower to said printing element and manually adjustable to determine when the transmission of motion is to be initiated while said cam follower is acted upon by the cam profile part of said print drive cam, thereby determining a distance over which said printing element is driven by said second cam profile part of said print drive cam;

said printing element being normally positioned at said fixed rest position independent of said manually adjustable impression control means to thereby provide an operator of the typewriter with optimum visibility of the printed characters.

3. An impression control mechanism for a single element typewriter, comprising:

a platen;

a single printing element;

means mounting said printing element for movement from a fixed rest position towards said platen;

means for defining said fixed rest position of said element;

means for urging said element towards said rest position;

a cyclically operable print drive cam having a cam profile including a first part for displacing said printing element from said rest position towards said platen without providing substantial energy for printing to said printing element and a second part contiguous to said first part for driving said printing element until a predetermined position is reached to provide substantial energy for printing to said printing element;

motion transmitting means interposed between said cam and said means for mounting for transmitting motion of said cam to said printing element; and manually adjustable impression control means for defining a first distance over which said printing element is displaced from said rest position by the action of said first part of said cam profile of said cam to thereby define a second distance to said predetermined position over which said printing element is driven by said second part of said cam profile;

said printing element being normally positioned at said fixed rest position independent of said manually adjustable impression control means to thereby provide an operator of the typewriter with optimum visibility of the printed characters.

4. An impression control mechanism as claimed in claim 3, wherein said manually adjustable impression control means includes a manually adjustable lever pivotally mounted on said means for mounting, and said motion transmitting means includes a cam follower engaging with said cam and having an arcuate cam section thereon, and a motion transmitting element fixedly mounted on said lever such that it is normally clear of said cam follower and is brought into engagement with said cam section of said cam follower while said cam follower is acted upon by said first part of said cam profile of said cam so as to thereafter transmit motion of said cam follower to said printing element; said lever being manually adjustable to position said motion transmitting element relative to said cam follower to thereby define said first and second distances.

5. An impression control mechanism as claimed in claim 4, wherein said cam follower is a bellcrank mounted for pivotal motion about a fixed axis and having a first arm which has said arcuate cam section formed thereon and a second arm which has at its free end a roller disposed for engagement with said print drive cam.

6. An impression control mechanism as claimed in claim 4, wherein said cam follower is a bellcrank having an arm which has said arcuate cam section formed thereon, and said means for defining said rest position includes:

an abutment member on said means for mounting;

a pin for supporting said bellcrank for pivotal motion therearound; and an element on said pin normally engaged with said abutment member to retain said printing element to said rest position against the urging of said means for urging.

* * * * *